US005160796A

United States Patent [19]

Tuma et al.

[11] Patent Number: 5,160,796

[45] Date of Patent: Nov. 3, 1992

[54] AUTOMATIC SMALL ARM

[76] Inventors: Martin Tuma, Allmendstrasse 31B, 4503 Solothurn; Vaclav Brunclik, Lättenstrasse 106, 8142 Uitikon, both of Switzerland

[21] Appl. No.: 772,491

[22] Filed: Oct. 7, 1991

[51] Int. Cl.[5] ..... F41A 19/38

[52] U.S. Cl. ..... 42/69.03; 89/147

[58] Field of Search ..... 42/69.03, 69.02, 69.01; 89/147, 141, 145

[56] References Cited

U.S. PATENT DOCUMENTS

| | | | |
|---|---|---|---|
| 2,464,427 | 3/1949 | Wilson | 89/147 |
| 3,152,418 | 10/1964 | Charron | 42/69.03 |
| 3,722,358 | 3/1973 | Seecamp | 89/147 |
| 4,275,640 | 6/1981 | Wilhelm | 89/147 |

*Primary Examiner*—Michael J. Carone
*Attorney, Agent, or Firm*—Ladas & Parry

[57] ABSTRACT

The gun can be switched to operate either in a double action or as single mode. A pin located in the slide can be rotated from a position, in which a jacket surface is flush with the bottom surface of the slide to a position where a nose projects above the bottom surface of the slide. The sear has a control cam which is acted upon by the nose of the pin when in its projecting state. The hammer includes a detent member having two abutment shoulder sections adapted to cooperate with a control edge of the sear. If the pin is in a position, in which mentioned jacket surface is flush with the bottom surface of the slide, it does not act upon the control cam of the sear such that upon the loading or a firing of the gun, the hammer is held in the fully cocked position, in that the first control edge of the sear engages the forward abutment shoulder section of the detent member. This is the single action mode. If the nose of the pin projects over the bottom surface of the slide, it depresses the control cam of the sear during the forward movement of the slide after having recoiled such that the control edge of the sear engages the second abutment shoulder section of the detent member of the hammer, wherewith the hammer is held in a precocked position and must be cocked firstly before firing a subsequent shot. This is the double action mode.

10 Claims, 6 Drawing Sheets

AUTOMATIC SMALL ARM

BACKGROUND OF THE INVENTION

1. Field of the Invention

The present invention relates to an automatic small arm and specifically to a handgun including a frame; a slide mounted on said frame for a linear reciprocatable movement thereon; a hammer pivotally mounted to the frame to pivot between a cocked and a firing position, which hammer projects into the path of movement of said slide and includes a detent member having at least one abutment shoulder section; a hammer rod spring adapted to bias said hammer towards its firing position; a trigger pivotally mounted to the frame and a trigger rod linked to the trigger and guided to move upon a pulling of the trigger in a direction generally towards the hammer, which trigger rod includes an abutment surface; a rotatable spring biassed sear arranged to cooperate with the trigger rod and with the detent member, and having a first and a second control edge; which first control edge is adapted to cooperate with the at least one abutment shoulder section of the detent member in order to lock the hammer against the biassing force of the hammer rod spring in its cocked position, and which second control edge is adapted to cooperate with the abutment surface of the trigger rod, such that upon a trigger initiated movement of the trigger rod in a direction towards the hammer the abutment surface urges the second control edge to cause a rotation of the sear against its spring bias to rotate the first control edge away from and out of contact with the at least one abutment member section allowing the hammer to snap into its firing position.

2. Description of the Prior Art

Generally, hand held small arms are divided into two groups, namely pistols and revolvers. Each group has its advantages and disadvantages. Pistols have a higher firing power, i.e. they can carry in their magazine more rounds than a revolver, generally termed six-shooter. If desired, pistols can be equipped with a manually operable safety catch for a single action shooting which is active when the hammer is in its cocked position. Furthermore, the reloading, i.e. changing of the magazine is much faster than in case of revolvers.

Revolvers, in turn, display a constant resistance when pulling the trigger which increases the accuracy when firing a single shot. Further, they operate only in the double action mode. Also, it is possible to manually cock the hammer for one single aimed shot.

SUMMARY OF THE INVENTION

There is now the desire for and a general object of the invention to provide a handgun which can be fired in a double action mode and yet allows a manual cocking of the hammer for a firing of one single shot, as well.

A further object is to provide a handgun, in which the detent member of the hammer comprises a second abutment shoulder section located at a distance from the at least one abutment shoulder section, in which the sear comprises a control cam adapted to cooperate with a control member located in the slide and adapted to sweep over and contact the control cam in order to depress same upon a moving of the slide on the frame.

Another object of the invention is to provide a handgun which can be fired in a single action mode and in a double action mode and in which the detent member of the hammer comprises a second abutment shoulder section located at a distance from the at least one abutment shoulder section, in which the sear comprises a control cam adapted to cooperate with a control member located in the slide and adjustable between an active and an inactive position and arranged to sweep over and contact the control cam in its active position in order to depress same upon a moving of the slide on the frame.

Still a further object is to provide a handgun, in which the detent member is formed by a projecting member at the hammer, having a free end, at which end the at least one abutment shoulder section is located, and in which the second abutment shoulder section is located on the projecting member between the at least one abutment shoulder section and the hammer body.

Yet a further object is to provide a handgun, in which the slide has a planar bottom surface area opposite of the control cam of the sear and the control member is a pin which is shaped in rotatably supported such in a bore hole located in the slide that in the control member's active position the pin forms a nose projecting over the bottom surface area.

A further object is to provide a handgun, in which the pin and the bore hole both have a cross-sectional shape corresponding to the residual area of a circle having a cutaway segment, whereby the chord of the segment of the bore hole is aligned with the planar bottom surface area of the slide such that the wall of the bore hole has an opening at the planar bottom surface area.

Still a further object is to provide a handgun, in which the pin shaped control member has a first and a second detent adapted to receive a spring biassed arresting body located in the slide and adapted to arrest the control member in its active and inactive, respectively, positions.

Yet a further object is to provide a handgun, in which the first detent is formed by the intersection between a diametrical through bore through the pin and the outer surface of the pin, and the second detent is formed by a recess in the surface of the pin.

A further object is to provide a handgun, in which the control cam of the sear has a curvilinear control surface at its side facing the slide.

Still a further object is to provide a handgun having an interrupter pivotably mounted to the detent member and adapted to cooperate with the trigger rod, which interrupter includes a tip resting against an incline formed at the frame, whereby a relative movement between the interrupter and the incline causes a pivoting movement of the interrupter relative to the trigger rod in a direction of mutual engagement or disengagement, respectively.

BRIEF DESCRIPTION OF THE DRAWINGS

The invention will be better understood and objects other than those set forth above will become apparent when consideration is given to the following detailed description thereof. Such description makes reference to the annexed drawings, wherein.

DESCRIPTION OF THE PREFERRED EMBODIMENTS

Figure 1:
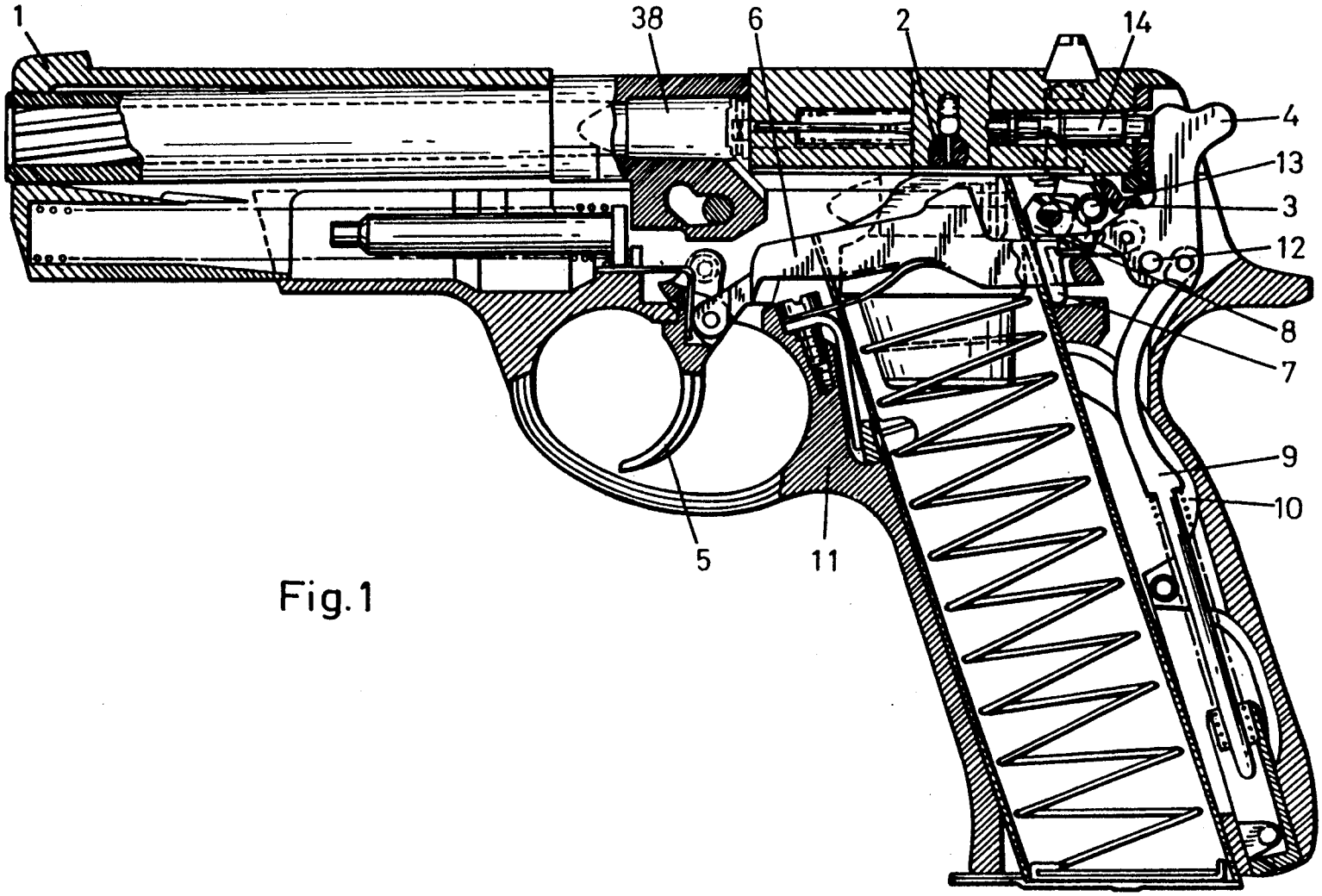
FIG. 1 is a cross section through a pistol according to an embodiment of the present invention.

FIG. 1 is a sectional view of a handgun, in which an embodiment of the present invention is represented. The handgun includes a slide 1 which is supported on a frame 11. The slide 1 is in a well-known manner linearly reciprocatable relative to the frame 11. A trigger 5 is pivotally mounted to the frame 11 and a trigger rod 6 is linked to the trigger. The trigger rod 6 is mounted at such a point to the trigger 5 that upon pulling the trigger the trigger rod will move towards the hammer 4 which is supported via the hammer pin 12 on the frame 11. The trigger rod 6 is adapted to cooperate with the sear 3 in a manner to be described further below, which sear is supported via the sear pin 13 in the frame 11. Further visible is the interrupter 7 which is linked to the hammer 4 and the ejector 8 adapted to expel a spent cartridge. The hammer 4 is linked to the hammer rod 9, on which the hammer rod spring 10 acts such to bias the hammer 4 towards its firing position. The firing pin is identified by the reference numeral 14.

The above described structural members of the handgun are well known as is the general design of such a handgun such that for the reasons of the disclosure there is no need to enter further into details of the design because they are well known to the person skilled in the art.

Figure 2:
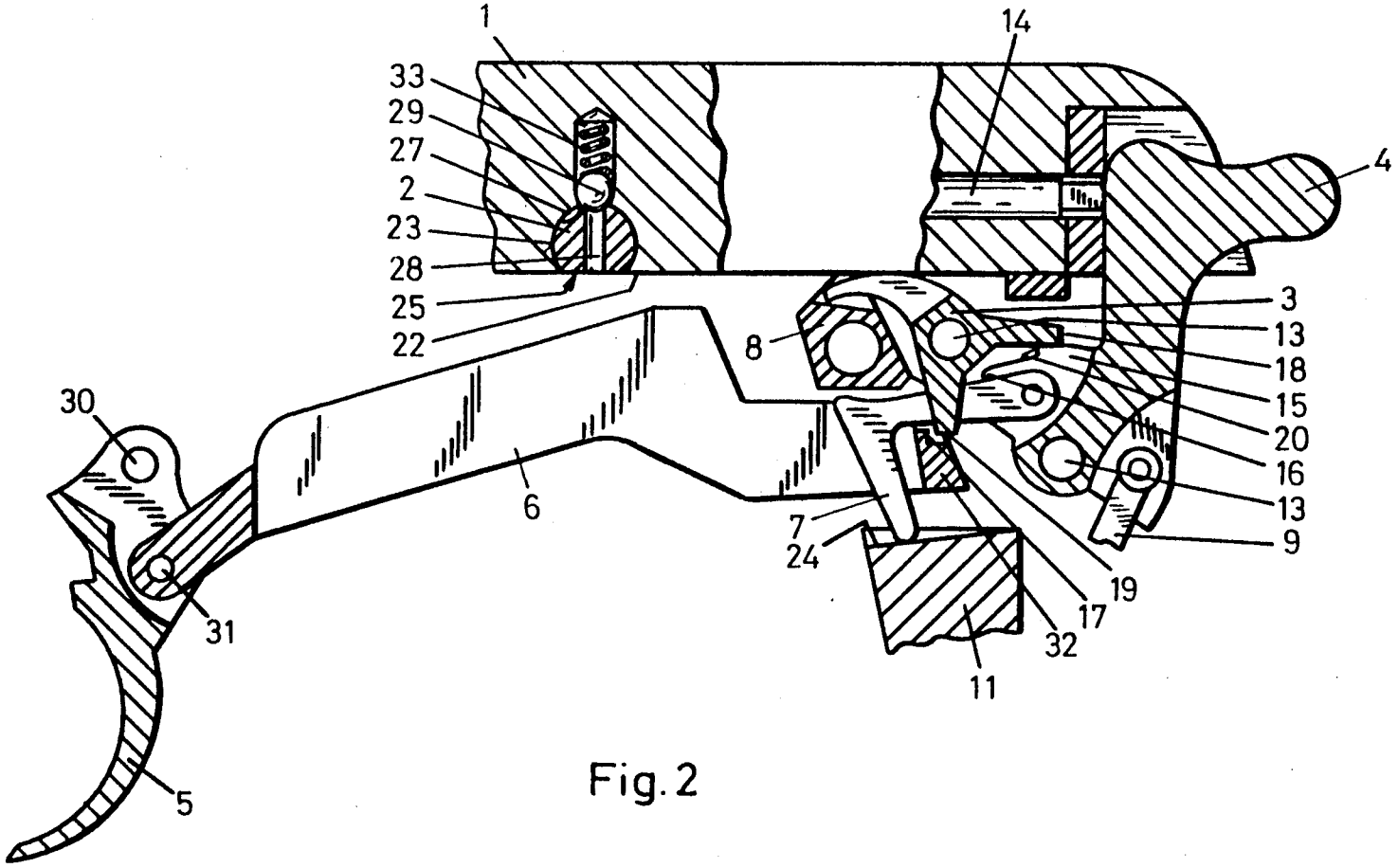
FIG. 2 is a sectional view of the operating parts of a handgun in a single action/double action mode.
Figure 3:
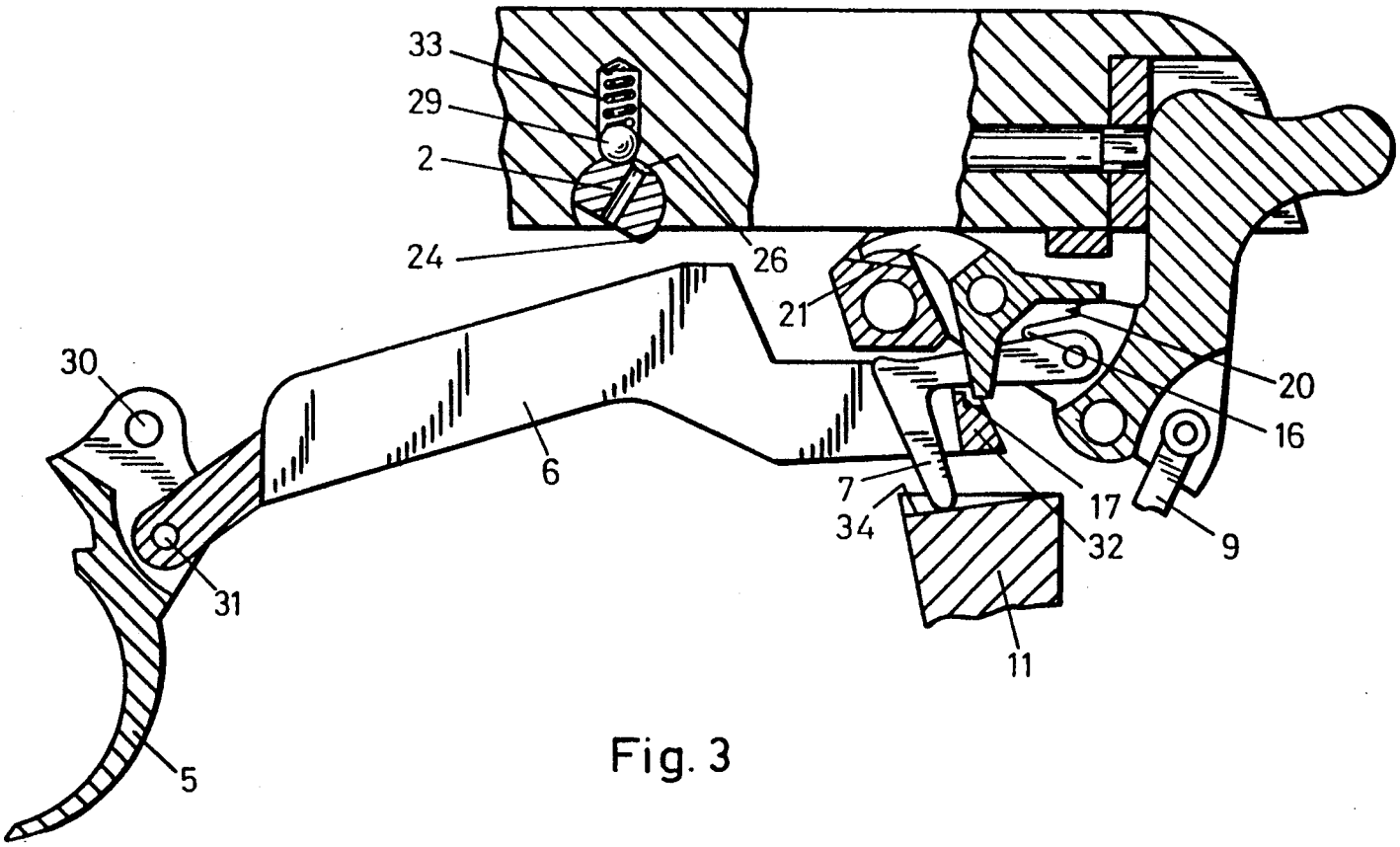
FIG. 3 is a sectional view of the operating parts of a gun in their double action mode.
Figure 4:
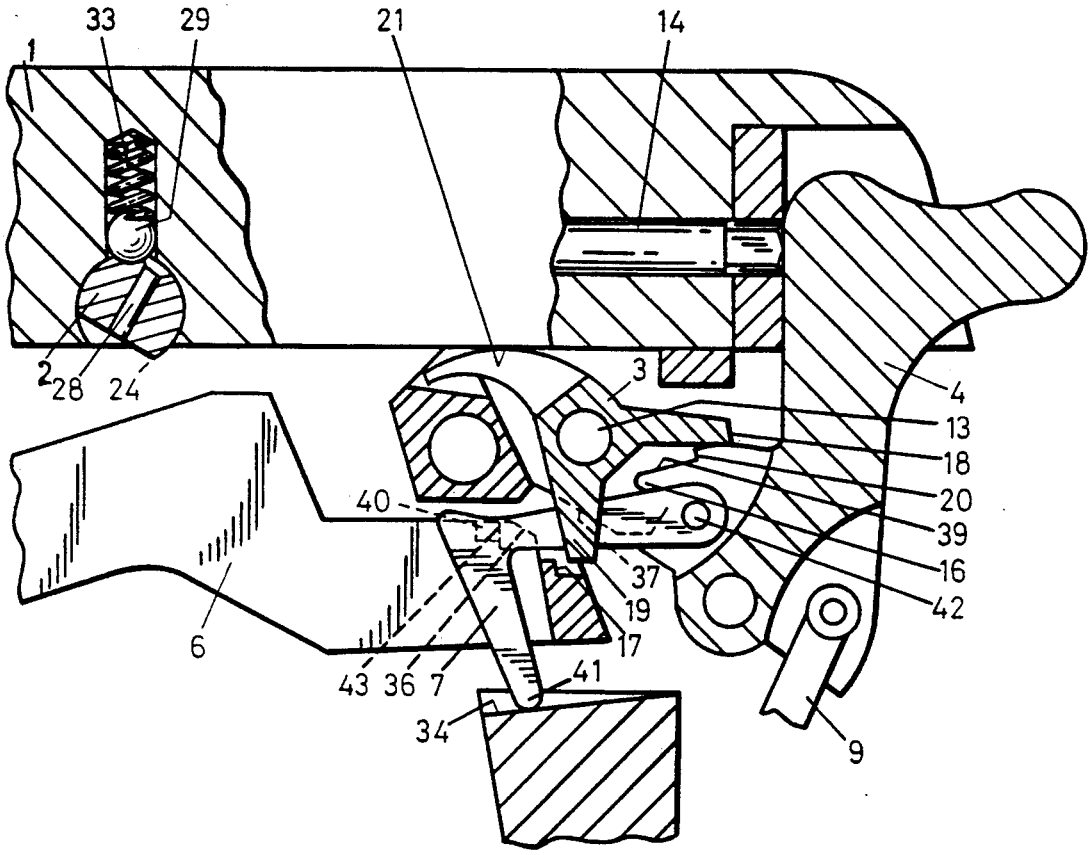
FIG. 4 is a view similar to FIG. 3 on an enlarged scale.

Attention is now drawn to the FIGS. 2 and 3, which illustrate the operating structures of the embodiment of the invention of FIG. 1 on an enlarged scale and in two operating modes and FIG. 4 corresponds to the illustration of FIG. 3 on a still more enlarged scale to clearly illustrate further details.

The trigger 5 is pivotally supported by the trigger pin 30 in the frame 11. The trigger rod 6 is linked at the pivotal point 31 to the trigger 5. At its rear end the trigger rod 6 is formed with the well-known cross piece 32 which also is visible in FIG. 6. On this cross piece 32 an abutment surface 17 is visible (see FIGS. 2 and 3). The sear 3 is supported by the sear pin 13 in the frame 11. As is well known, the sear 3 is spring biassed by a not particularly illustrated sear spring in the clockwise sense when viewing FIGS. 2–4.

As can be seen specifically clearly in FIG. 4 the sear 3 has a first control edge 18 and a second control edge 19 located at a distance therefrom. The sear 3 includes further a control cam 21 having a curvilinear upper surface. Reference numeral 8 identifies the ejector. The hammer 4, see FIG. 2, is hinged via the hammer pin 12 to the frame 11 and a short part of the hammer rod 9 linked to the hammer 4 is illustrated, too. The hammer 4 is adapted to strike upon the firing pin 14 supported in the slide 1.

The hammer 4 includes a detent member 15 which is a forked projection at the lower end of the hammer 4, thus projects forward from the hammer body. This forked projection forming the detent member has at its free end an abutment shoulder section consisting due to the forked nature of the projection of two abutment shoulders 16, 16*a*, and has a further or second abutment shoulder section consisting likewise of two abutment shoulders 20, 20*a* located between the abutment shoulders 16, 16*a* and the hammer body. See hereto specifically FIG. 6.

In the slide 1 a control member, the system selector, in form of a pin 2 is supported such that a part thereof is flush with the planar bottom surface 22 of the slide 1 in the mode illustrated in FIG. 2. The pin 2 has a cross-sectional shape corresponding to the residual area of a circle having a cut-away segment, whereby the chord of the segment as visible in FIG. 2 is flush with the planar bottom surface 22. This pin 2 is rotatably supported in a bore hole 23 having a cross-sectional shape corresponding to such of the pin, whereby the chord of the cut-off segment at the bore hole is aligned with the bottom surface 22 such that the wall of the bore hole has an opening 25 at this bottom surface 22 facing downwards. The pin 2 is rotatable between two positions. The first position is illustrated in FIG. 2, where, as already been mentioned, the planar jacket surface of the pin 2 is flush with the planar bottom surface 22 of the slide 1.

The second position of the pin 2 is illustrated in FIG. 3 and as can be seen, the pin 2 has been rotated in a clockwise direction and due to its specific cross-sectional shape the pin 2 forms now a nose 24 projecting over the planar bottom surface 22 of the slide 1.

In order to arrest this pin 2 in the two positions, an arresting body 29 biassed by a spring 33 is arranged in the slide 1 to arrestingly cooperate with the pin 2. The pin 2 includes hereto a through bore 28 such that the intersection between the through bore and the outer surface of the pin 2 forms a first detent 26 to arrest the pin 2 in the rotational position as illustrated in FIG. 2. At the side of this first detent 26 a second detent 27 in form of a simple recess is provided, by means of which second detent 27 the arresting body 29 arrests or locks, respectively, the pin 2 in its position illustrated in FIG. 3.

The interrupter 7 is pivotally mounted to the hammer 4 and rests at its lower end at an incline 34 formed on a section of the frame 11. The pivot axis of the interrupter 7 is identified in FIGS. 4 and 6 by the reference numeral 42. In order to manually operate the systems selector the pin 2 ends at the outer surface (see FIG. 5) of the slide 1 to form a knob, whereby as example a rib 35 is present, which can be gripped between the thumb and the index finger to rotate the pin 2 between the two positions such as e.g. illustrated by marks on the outer surface of the slide.

For sake of good order FIG. 4 also illustrates the chamfer 36 at the rear end of the trigger rod 6 and the incline 37 which is stationary relative to the trigger rod 6 as is also well known.

When operating the gun in the single action/double action mode, the pin 2 is in the position as illustrated in FIG. 2. It shall be noted, that this position corresponds basically to the single action mode, but it is also possible to proceed in accordance with the double action movements.

While the pin 2 is rotated in a position that its flat planar surface area is flush with the planar bottom surface area 22, the slide 1 is pulled back for a e.g. initial loading of the gun and specifically for the cocking of the hammer 4. The slide 1 which contacts the hammer 4 causes the hammer 4 to rotate backwards around the hammer pin 12. The sear 3 which is spring biassed in the clockwise direction based on the illustration of FIG. 2 lies at its arm which has the first control edge 18 under exertion of some pressure on the projecting detent member 15 of the hammer 4. When the hammer 4 has pivoted completely to the right due to the linear movement of the slide 1, the first control edge 18 of the sear 3 comes to rest against the abutment shoulders 16, 16*a* at the end of the detent member 15 of the hammer 4 such that the hammer 4 is maintained in its cocked position.

The slide 1 is thereafter released and moves back into its initial position. It pushes thereby one round out of the magazine into the chamber, which round is identified by the reference numeral 38 in FIG. 1. Because no part of the pin 2 projects over the planar bottom surface 22 of the slide 1, there is no action on the sear 3.

For firing the gun the trigger 5 is pulled, wherewith the trigger rod 6 is pushed backwards, i.e. towards the hammer. Towards the end of this backwards movement the trigger rod 6 contacts at its abutment surface 17 the second control edge 19 of the sear 3 at the bottom end of the arm of the sear 3 extending in the drawings vertically downwards. The continued movement of the trigger rod 6 causes the sear 3 to rotate against the biassing force of the spring counterclockwise around the sear pin 13. Conclusively, the first control edge 18 of the sear 3 is rotated away from the abutment shoulders 16, 16*a* of the hammer 4 such that the biassing force of the hammer rod spring 10 can freely act onto the hammer 4, which hammer 4 rotates around the hammer pin 12 to snap against the firing pin 14, thus striking the pin which in turn strikes the round 38 such that a shot is fired.

The recoil causes the slide 1 to move again backwards, which slide 1 causes the hammer 4 to rotate again backwards such that it is cocked, whereby during this movement of the hammer 4 the first control edge 18 of the sear 3 comes again to rest against the abutment shoulders 16, 16*a* in order that the hammer 4 is in its cocked position. The slide 1 returns again into its initial position and loads the next round out of the magazine into the barrel such that the gun is again ready for firing. This is the automatic cocking of the hammer 4.

Figure 5:
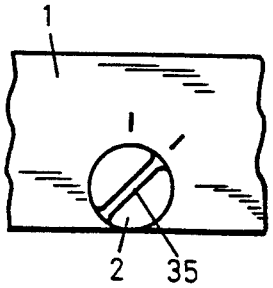
FIG. 5 is a side view of the handgun to illustrate the view of the pin at the side of the slide.

In order now to have the double action operation only, the selector pin 2, see FIG. 5, is rotated such that the pin 2 assumes the position illustrated in FIGS. 3 and 4. Specific to this position is that due to the particular cross-sectional design of the pin 2 it projects over the bottom surface 22 of the slide 1 such that it forms a nose 24 projecting over the bottom surface 22. This nose 24 can now cooperate with the control cam 21 of the sear 3.

For loading the gun the slide 1 is pulled backwards such that the hammer 4 is again moved as above into the cocked position. Upon releasing the slide 1 it moves again forwards into its initial position and transports a round from the magazine into the chamber.

As long as the slide 1 is in its rearmost position, the cocked hammer 4 is held as above due to the interaction between the first control edge 18 of the sear 3 and the abutment shoulders 16, 16*a* of the hammer 4. When now the slide 1 is let go such that it moves forwards into its initial position, the nose 24 will contact during the forwards movement the control cam 21 of the sear 3 such that it rotates around the sear pin 13 counterclockwise by a small margin. Thus, the first control edge 18 of the sear 3 moves out of contact with the abutment shoulders 16, 16*a* such that the hammer 4 pivots under the action of the hammer rod spring 10 counterclockwise, pivoting around the hammer pin 12. The location of the nose 24 is now selected, depending on the spring force of the hammer rod spring 10 that as soon as the nose 24 has passed and accordingly released the control cam 21, the arm of the sear 3 having the first control edge 18 safely contacts the surface areas 39, 39*a* between the first abutment shoulders 16, 16*a* and the second abutment shoulders 20, 20*a* such that now the control edge 18 of the sear 3 comes to contact during the pivoting movement of the hammer 4 its second abutment shoulders 20, 20*a* to block the hammer 4 preventing a further pivoting in the counterclockwise direction.

Accordingly, the hammer 4 is in a precocked position and specifically cannot contact the firing pin 14, although it has left its cocked position. This not only increases the safety when handling the weapon but allows during the next following firing a softer pulling through of the trigger.

In order to fire the gun the trigger 5 is pulled and again the trigger rod 6 moves backwards. Its abutments 40, 40*a* contact the surfaces 43, 43*a* of the interrupter 7 such that it is also pushed backwards, an operation well known in the art. The interrupter 7 causes the hammer 4 to rotate around the hammer pin 12 such that the hammer rod spring 10 is compressed by the hammer rod 9.

In the rearmost position of the trigger rod 6 its chamfer 36 contacts the incline 37 at the ejector 8 and the rear end of the trigger rod 6 begins to move downwards. At the same time the interrupter 7 resting on the incline 34 at the frame 11 pivots upwards and therewith the contact between the abutments 40, 40*a* and the surfaces 43, 43*a* and accordingly between the trigger rod 6 and the interrupter 7 is severed such that the hammer 4 can snap forwards and strike the firing pin 14 in order to fire the round.

During the very last stretch of its backwards movement the trigger rod 6 contacts the sear 3 to rotate it around the sear pin 13 such that the first control edge 18 is moved upwards and away from the abutment shoulders 16, 16*a* and 20, 20*a* in order not to block the pivoting movement of the hammer 4 towards the firing pin striking position.

After the shot has been fired, the slide 1 recoils and rotates as mentioned above the hammer 4 into its cocked position. Thereafter the slide 1 moves again into its initial position and again the nose 24 depresses the control cam 21 of the sear 3 when passing thereover such that the control edge 18 of the sear 3 does not block the hammer 4 at the forward abutment shoulders 16, 16*a*, but rather at the second abutment shoulders 20, 20*a*, wherewith the hammer 4 is again in its precocked position. Thus, the hammer 4 is not cocked and for firing the next shot the trigger 5 must be pulled to move the hammer 4 into its fully cocked position.

The above embodiment of the invention is an automatic small arm adapted to be fired in a single action or double action mode.

Figure 7:
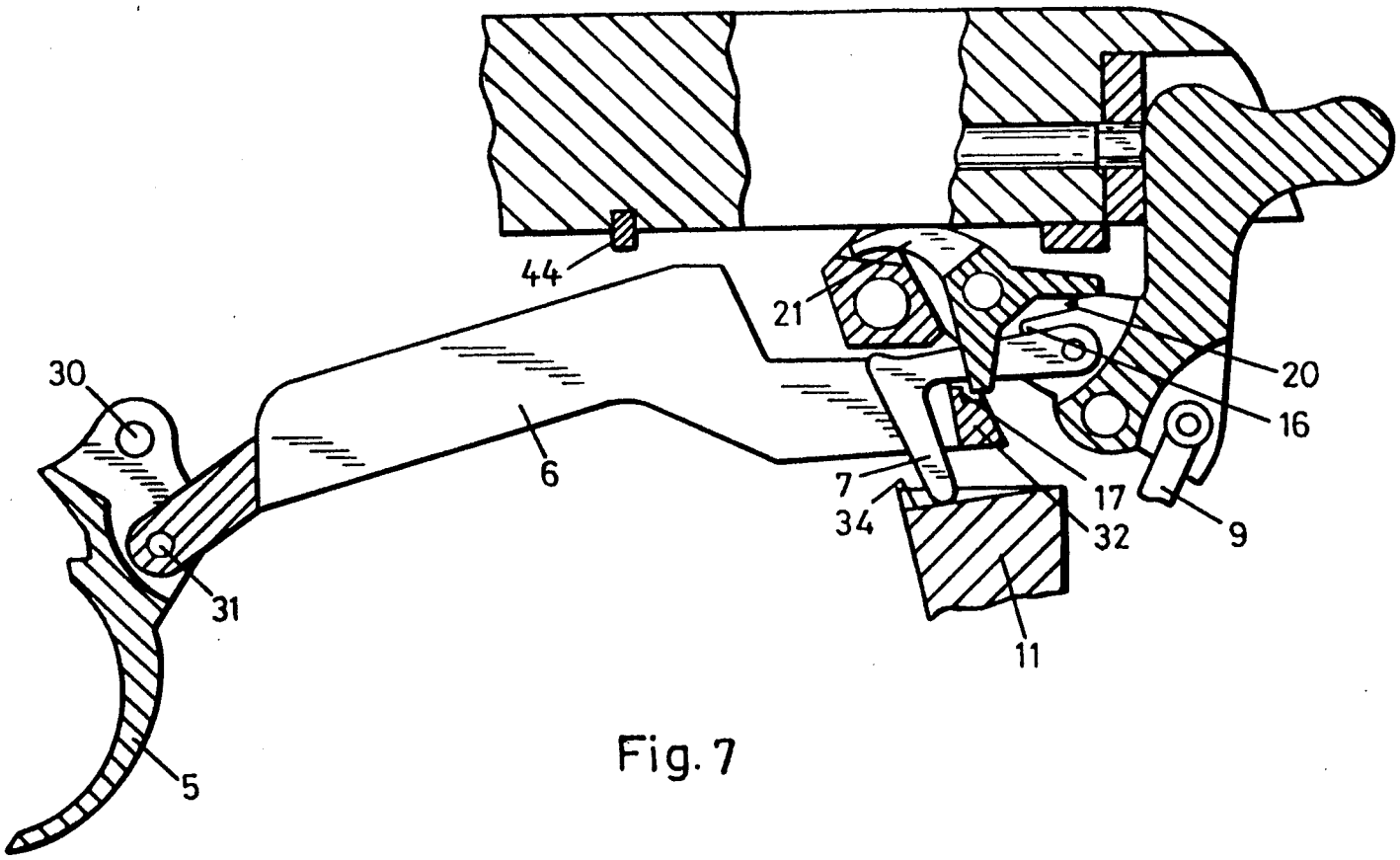
FIG. 7 is a view similar to FIGS. 2–4 to illustrate the operating parts of a double action design embodiment which also allows a manual cocking of the hammer.

A further embodiment of the invention is illustrated in FIG. 7. This embodiment is a double action handgun, of which, however, the hammer can be cocked manually, i.e. by means of the thumb. A peg 44 operating as a cam is inserted in the slide. In place of this peg 44 a further embodiment foresees merely a projection at the bottom of the slide which is formed integrally with the slide such by a corresponding machining of the bottom of the slide. This peg 44 cooperates with the control cam 21 of the sear 3.

For the initial loading of the gun the slide 1 is pulled backwards such that the hammer 4 is rotated into the cocked position. Upon releasing the slide 1 it moves again forwards into its initial position and transports a round from the magazine into the chamber.

Figure 6:
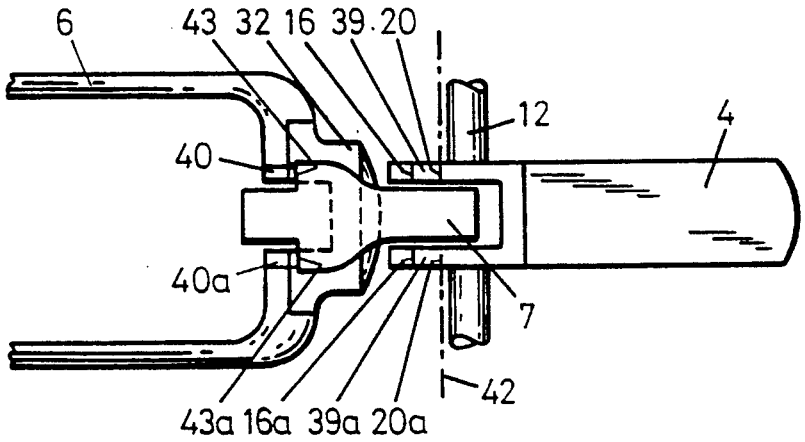
FIG. 6 is a top view of the hammer, the interrupter and rear end of the trigger rod.

As long as the slide 1 is in its rearmost position, the cocked hammer 4 is held due to the interaction between the first control edge 18 of the sear 3 and the abutment shoulders 16, 16*a* of the hammer 4 (See also FIGS. 2 and 6). When now the slide 1 is let go such that it moves forwards into its initial position, the peg 44 operating similar to a cam will contact during the forwards movement the control cam 21 of the sear 3 such that it rotates around the sear pin 13 counterclockwise by a small margin. Thus, the first control edge 18 of the sear 3 moves out of contact with the abutment shoulders 16, 16*a* such that the hammer pivots under the action of the hammer rod spring 10 counterclockwise, pivoting around the hammer pin 12. The location of the pin 44 is selected, depending on the spring force of the hammer rod spring 10 that as soon as the pin 44 has passed and accordingly again released the control cam 21, the arm of the sear 3 having the first control edge 18 safely contacts the surface areas 39, 39*a* between the first abutment shoulders 16, 16*a* and the second abutment shoulders 20, 20*a* such that now the control edge 18 of the sear 3 comes to contact during the pivoting movement of the hammer 4 its second abutment shoulders 20, 20*a* to block the hammer 4 preventing a further pivoting movement thereof.

Accordingly, the hammer 4 is in a precocked position and specifically cannot contact the firing pin 14, although it has left its cocked position.

The firing of the gun and the respective movements of the various structural elements proceed in accordance with those as described earlier with reference to the double action mode of the first embodiment incorporating a single action/double action gun.

This embodiment now, i.e. the embodiment according to FIG. 7, is solely and exclusively a double action gun. After a shot has been fired, a shot the hammer 4 always moves forward until the control edge 18 of the sear 3 comes to contact the second abutment shoulders 20, 20*a*.

At this position of the hammer 4 and when the slide 1 is in its forward position, it is now possible to pivot by means of the thumb the hammer 4 backwards, in other words to cock the hammer 4 until the first control edge 18 of the sear 3 snaps into the first abutment shoulders 16, 16*a*, such that now the hammer 4 is in its fully cocked position. By pulling now the trigger 5 the gun will be fired. The advantage here is as follows. When a shot has been fired and the slide has recoiled and moved again forwards, the hammer 4 pivots, as mentioned above, also forwards until the control edge 18 of the sear 3 snaps into the abutment shoulders 20, 20*a*. When firing the gun the trigger 5 must be pulled over a certain distance, overcoming spring forces, to fully cock the hammer for the subsequent firing of the gun. When now the hammer 4 is cocked manually by rotating it backwards, the hammer can be rotated until the control edge 18 of the sear 3 snaps into the abutment shoulders 16, 16*a*. When pulling now the trigger 5 to give a single shot the hammer 4 must be rotated by quite a shorter distance, such that also the trigger 5 must be pulled by a shorter distance. The person firing the gun must exert a much smaller force on the trigger 5 in order to pull it back to fire the gun such that, as generally known, the aiming and firing of the single shot will proceed with a much higher accuracy.

Thus, this embodiment is an automatic double action gun which yet allows a manual cocking for firing a carefully aimed shot.

While there are shown and described present preferred embodiments of the invention, it is to be distinctly understood that the invention is not limited thereto, but may be otherwise variously embodied and practiced within the scope of the following claims.

We claim:

1. A handgun including a frame;

a slide mounted on said frame for a linear reciprocatable movement thereon;

a hammer pivotally mounted to said frame to pivot between a cocked and a firing position, which hammer projects into the path of movement of said slide and includes a detent member having at least one abutment shoulder section;

a hammer rod spring adapted to bias said hammer towards its firing position;

a trigger pivotally mounted to said frame and a trigger rod linked to said trigger and guided to move upon a pulling of the trigger in a direction generally towards said hammer, which trigger rod includes an abutment surface;

a rotatable spring biassed sear arranged to cooperate with said trigger rod and with said detent member, and having a first and a second control edge;

which first control edge is adapted to cooperate with said at least one abutment shoulder section of said detent member in order to lock said hammer against the biassing force of said hammer rod spring in its cocked position; and which second control edge is adapted to cooperate with said abutment surface of said trigger rod, such that upon a trigger initiated movement of said trigger rod in a direction towards said hammer the abutment surface urges said second control edge to cause a rotation of said sear against its spring bias to rotate said first control edge away from and out of contact with said at least one abutment shoulder section allowing the hammer to snap into its firing position;

in which said detent member of said hammer comprises a second abutment shoulder section located at a distance from said at least one abutment shoulder section;

said sear comprises a control cam adapted to cooperate with a control member located in said slide and adapted to sweep over and contact said control cam in order to depress same upon a moving of said slide on said frame.

2. The handgun of claim 1, in which said detent member is formed by a projecting member at the hammer having a free end, at which end said at least one abutment shoulder section is located, and in which said second abutment shoulder section is located on said projecting member between said at least one abutment shoulder section and the hammer body.

3. The handgun of claim 1, in which said slide has a planar bottom surface area opposite of the control cam of said sear and said control member is a projection of said planar bottom surface area opposite of the control cam of said sear.

4. The handgun of claim 3, in which said projection is formed by a peg inserted in the slide.

5. The handgun of claim 1, in which said slide has a planar bottom surface area opposite of the control cam of said sear and said control member is a pin which is shaped and rotatably supported such in a bore hole located in said slide that in the control member's active position said pin forms a nose projecting over said bottom surface area.

6. The handgun of claim 5, in which said pin and said bore hole both have a cross-sectional shape corresponding to the residual area of a circle having a cut-away segment, whereby the chord of the segment of the bore hole is aligned with said planar bottom surface area of the slide such that the wall of the bore hole has an opening at said planar bottom surface area.

7. The handgun of claim 5, in which said pin shaped control member has a first and a second detent adapted to receive a spring biassed arresting body located in the slide and adapted to arrest the control member in its active and inactive, resp., positions.

8. The handgun of claim 7, in which the first detent is formed by the intersection between a diametrical through bore through said pin and the outer surface of said pin, and the second detent is formed by a recess in the surface of said pin.

9. The handgun of claim 1, in which said control cam of the sear has a curvilinear control surface at its side facing the slide.

10. The handgun of claim 1, comprising further an interrupter pivotably mounted to said detent member and adapted to cooperate with said trigger rod, which interrupter includes a tip resting against an incline formed at the frame, whereby a linear relative movement between said interrupter and said incline causes a pivoting movement of said interrupter relative to said trigger rod in a direction of mutual engagement or disengagement, respectively.

* * * * *